US011019894B2

(12) United States Patent
Harris

(10) Patent No.: US 11,019,894 B2
(45) Date of Patent: Jun. 1, 2021

(54) RECONFIGURABLE STORAGE DEVICE

(71) Applicant: ACCO Brands Corporation, Lake Zurich, IL (US)

(72) Inventor: Richard H. Harris, Xenia, OH (US)

(73) Assignee: ACCO Brands Corporation, Lake Zurich, IL (US)

( * ) Notice: Subject to any disclaimer, the term of this patent is extended or adjusted under 35 U.S.C. 154(b) by 0 days.

(21) Appl. No.: 16/706,361

(22) Filed: Dec. 6, 2019

(65) Prior Publication Data

US 2020/0107620 A1 Apr. 9, 2020

Related U.S. Application Data

(60) Continuation of application No. 16/155,443, filed on Oct. 9, 2018, now Pat. No. 10,568,398, which is a (Continued)

(51) Int. Cl.
*A45C 3/02* (2006.01)
*A45C 13/30* (2006.01)
(Continued)

(52) U.S. Cl.
CPC ..... *A45C 3/02* (2013.01); *A45C 13/30* (2013.01); *A45F 3/02* (2013.01); *A45F 3/04* (2013.01);
(Continued)

(58) Field of Classification Search
CPC .... A45F 4/02; A45F 3/02; A45F 3/047; A45F 3/14; A45F 2003/142; A45F 2003/023; A45C 2009/007; A45C 15/00
(Continued)

(56) References Cited

U.S. PATENT DOCUMENTS 294,622 A * 3/1884 Höninger ..... A45F 3/02 224/608
1,370,636 A 3/1921 Dwyer
(Continued)

FOREIGN PATENT DOCUMENTS

WO 2007127406 11/2007

OTHER PUBLICATIONS https://www.quora.com/What-are-carabiner-keychains-useful-for Christopher VanLang (Jan. 24, 2012).

*Primary Examiner* — Adam J Waggenspack
(74) *Attorney, Agent, or Firm* — Fitch, Even, Tabin & Flannery LLP

(57) ABSTRACT

A binder device including a body having a first cover and a second cover directly or indirectly pivotally coupled together and at least partially defining an inner compartment therebetween. The body further includes a binding mechanism positioned in the inner compartment, a first body securing device coupled to the body, and a second body securing device coupled to the body. The binder device includes a strap including first and second strap segments. The strap is movable between a first configuration wherein the first and second strap segments are releasably coupled together to form a continuous strap that is wearable over a shoulder of a user, and a second configuration wherein the first strap segment is releasably coupled the first body securing device and the second strap segment is releasably coupled to the second body securing device such that the first and second strap segments each at least partially defines a loop. Each loop is shaped and configured to receive an arm of a user therethrough such that the binder device is wearable on a back of the user in the manner of a backpack. Each strap segment is configured to be releasably coupled to only one of the first or second body securing devices.

20 Claims, 8 Drawing Sheets

Related U.S. Application Data division of application No. 14/932,141, filed on Nov. 4, 2015, now Pat. No. 10,165,837.

(60) Provisional application No. 62/074,914, filed on Nov. 4, 2014.

(51) Int. Cl.

| | |
|---|---|
| ***A45F 3/02*** | (2006.01) |
| ***A45F 3/04*** | (2006.01) |
| ***A45F 4/00*** | (2006.01) |
| *A45C 9/00* | (2006.01) |
| *A45F 4/02* | (2006.01) |

(52) U.S. Cl.

CPC ..... *A45F 4/00* (2013.01); *A45C 2009/007* (2013.01); *A45F 2004/023* (2013.01)

(58) Field of Classification Search

USPC ..... 224/604–605, 608, 577–579, 153; 150/108

See application file for complete search history.

(56) References Cited

U.S. PATENT DOCUMENTS

| | | | | |
|---|---|---|---|---|
| 5,285,833 | A | 2/1994 | Haxby | |
| 5,577,652 | A | 11/1996 | Cooper | |
| 5,769,295 | A | 6/1998 | Alves | |
| 5,988,474 | A * | 11/1999 | Smith, II | A45C 7/0077 224/153 |
| 6,138,882 | A | 10/2000 | Buettner | |
| 6,161,979 | A * | 12/2000 | Yamamoto | A45C 3/02 206/472 |
| 6,354,477 | B1 | 3/2002 | Trummer | |
| 6,460,746 | B1 * | 10/2002 | Amram | A45F 3/047 224/579 |
| 6,474,523 | B2 | 11/2002 | Morrison | |
| 6,626,601 | B1 | 9/2003 | Moor et al. | |
| 6,666,363 | B2 | 12/2003 | Godshaw et al. | |
| 7,387,226 | B2 | 6/2008 | Porter | |
| 8,113,399 | B2 * | 2/2012 | Lee | A45F 3/02 224/578 |
| 9,016,449 | B1 | 4/2015 | Soboyejo | |
| 2003/0173389 | A1 * | 9/2003 | Washington | A45C 13/02 224/576 |
| 2004/0065708 | A1 | 4/2004 | Amram | |
| 2004/0089687 | A1 | 5/2004 | Ammerman | |
| 2005/0236450 | A1 * | 10/2005 | Lannini | B63B 32/80 224/577 |
| 2007/0086845 | A1 * | 4/2007 | Merzon | A45C 3/02 402/73 |
| 2008/0035693 | A1 | 2/2008 | Lee | |
| 2010/0213224 | A1 | 8/2010 | Barr | |
| 2012/0261445 | A1 | 10/2012 | Demskey | |
| 2013/0292441 | A1 | 11/2013 | Shen | |

* cited by examiner

RECONFIGURABLE STORAGE DEVICE

This application is a continuation of U.S. patent application Ser. No. 16/155,443, filed on Oct. 9, 2018, now issued as U.S. Pat. No. 10,568,398, which is a divisional of U.S. patent application Ser. No. 14/932,141, filed on Nov. 4, 2015, now issued as U.S. Pat. No. 10,165,837, which in turn claims priority to U.S. Provisional Patent Application Ser. No. 62/074,914, filed on Nov. 4, 2014. The entire contents of these applications are hereby incorporated by reference.

The present invention is directed to a storage device, and more particularly, to a storage device with a strap that can be variously configured.

BACKGROUND

Storage bags or devices, such as binders, pouches, bags, pockets, briefcases and the like are used to store a variety of components. The storage devices may include an inner compartment in which components may be stored, and a handle or carrying strap. However, existing bags may not provide reconfiguration capabilities such that the bag can be carried in various manners.

SUMMARY

In one embodiment, the present invention is a binder device including a body having a first cover and a second cover directly or indirectly pivotally coupled together and at least partially defining an inner compartment therebetween. The body further includes a binding mechanism positioned in the inner compartment, a first body securing device coupled to the body, and a second body securing device coupled to the body. The binder device includes a strap including first and second strap segments. The strap is movable between a first configuration wherein the first and second strap segments are releasably coupled together to form a continuous strap that is wearable over a shoulder of a user, and a second configuration wherein the first strap segment is releasably coupled the first body securing device and the second strap segment is releasably coupled to the second body securing device such that the first and second strap segments each at least partially defines a loop. Each loop is shaped and configured to receive an arm of a user therethrough such that the binder device is wearable on a back of the user in the manner of a backpack. Each strap segment is configured to be releasably coupled to only one of the first or second body securing devices.

DETAILED DESCRIPTION

Figure 1:
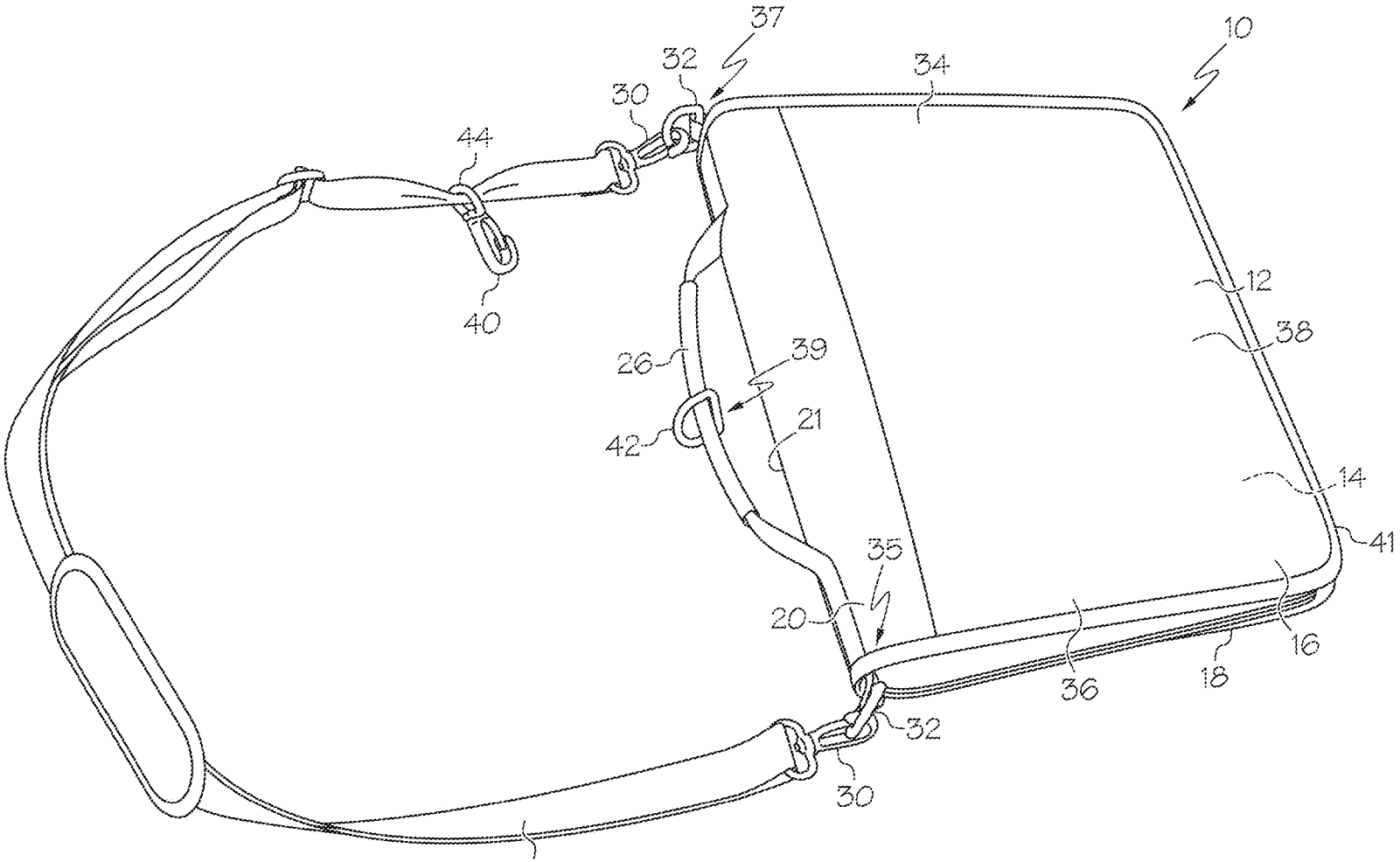
FIG. 1 is a front perspective view of one embodiment of the storage device in its closed position with the strap in a first configuration.

As shown in FIGS. 1-9, the storage device of the present invention, generally designated 10 or 10', can include a generally rectangular prism-shaped body or outer casing 12 having an inner compartment 14. The casing 12 can include a first or front cover or panel 16, a second or back cover or panel 18, and spine 20 positioned therebetween. The front cover 16 and back cover 18 may pivotally coupled along an associated hinge or fold line(s) 21 or areas. In one case a hinge line 21 is positioned on each side of the spine 20 and/or the entire spine 20 can be considered a fold area 21. It should be further understood that the storage device 10 need not necessarily include the spine 20, in which case panels 16, 18 can be directly pivotally coupled to each other along a single hinge line 21.

Figure 2:
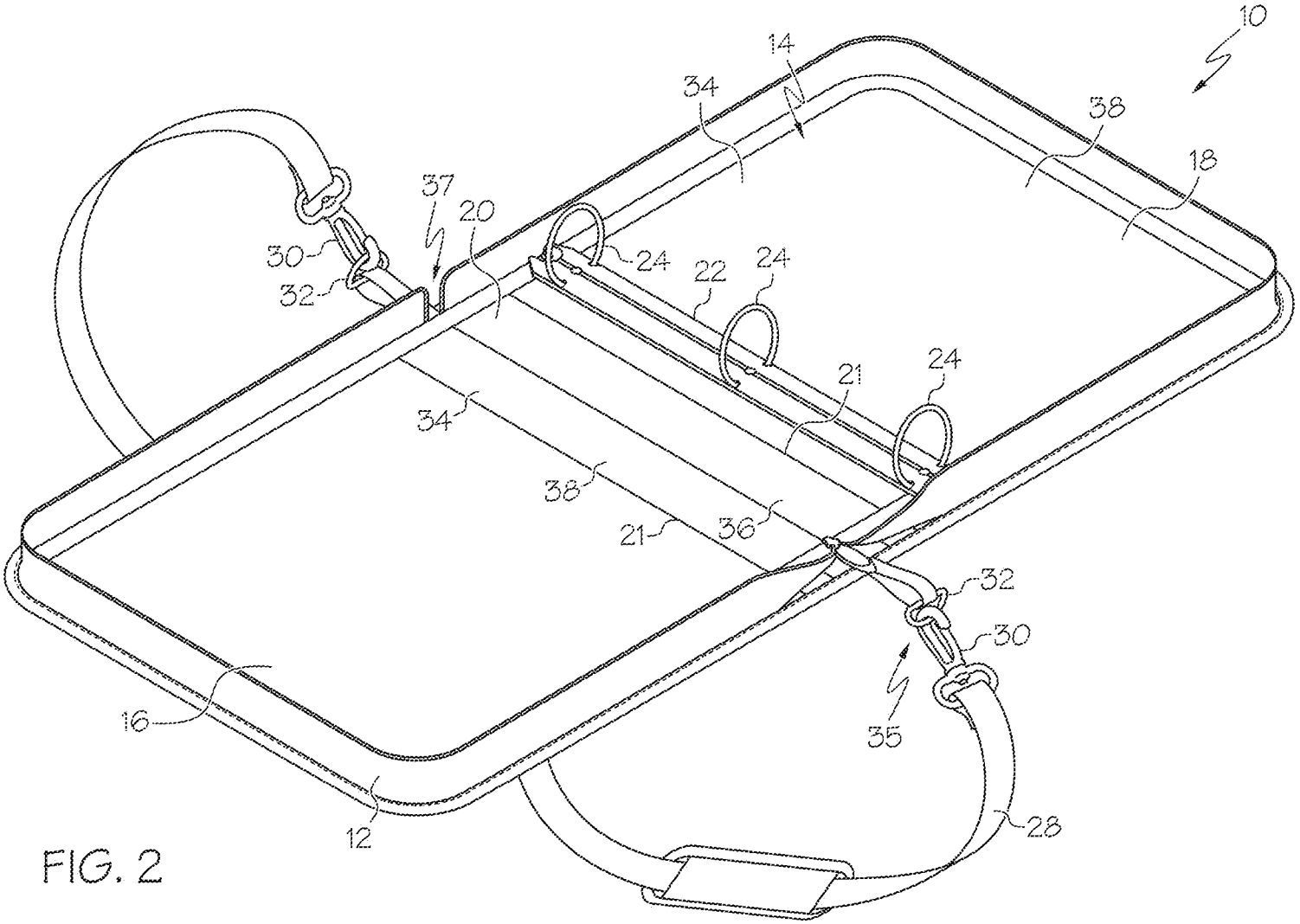
FIG. 2 is front perspective view of the storage device of FIG. 1 in its open position.

As shown in FIG. 2, the storage device 10 may also include a binding mechanism 22 coupled to an inner surface of the casing 12. In the illustrated embodiment the binding mechanism 22 takes the form of a three-ring binder or the like, including one or more binding rings 24. Each binding ring 24 may be separable into two separate ring halves or portions such that papers or other items can be bound to, or removed from, the binding mechanism 22. Each binding ring 24 may also be movable to a closed position (FIG. 2) in which the ring halves engage each other and form a closed ring to trap the bound contents therein. However, the binding mechanism 22 can take any of a variety of other forms or configurations besides ring binding mechanisms, such as a coil or wire bindings (including spiral and twin-wire bindings), clips, cords, ribbons, clamps, elastic connectors, adhesives, book-style bindings, and combinations thereof.

The binding mechanism 22 can be positioned in the inner compartment 14 such that various bound items can be positioned in the inner compartment 14. In addition, various pockets or the like can be positioned in the inner compartment 14 or items can be loosely positioned in the inner compartment 14. The illustrated storage device 10 further includes a handle 26 positioned on an outer surface of the casing 12 to provide a convenient structure by which a user can carry the storage device 10. In one case the handle 26 provides or defines an opening through which a user can extend his or her hand to manually carry the casing 12. Moreover the storage device 10 need not necessarily include a binding mechanism 22 and need not take the form of a binder. The storage device 10 could instead take the form of, for example, a bag, pocket, pouch, briefcase etc., or nearly any component capable of being carried and storing items therein.

Figure 3:
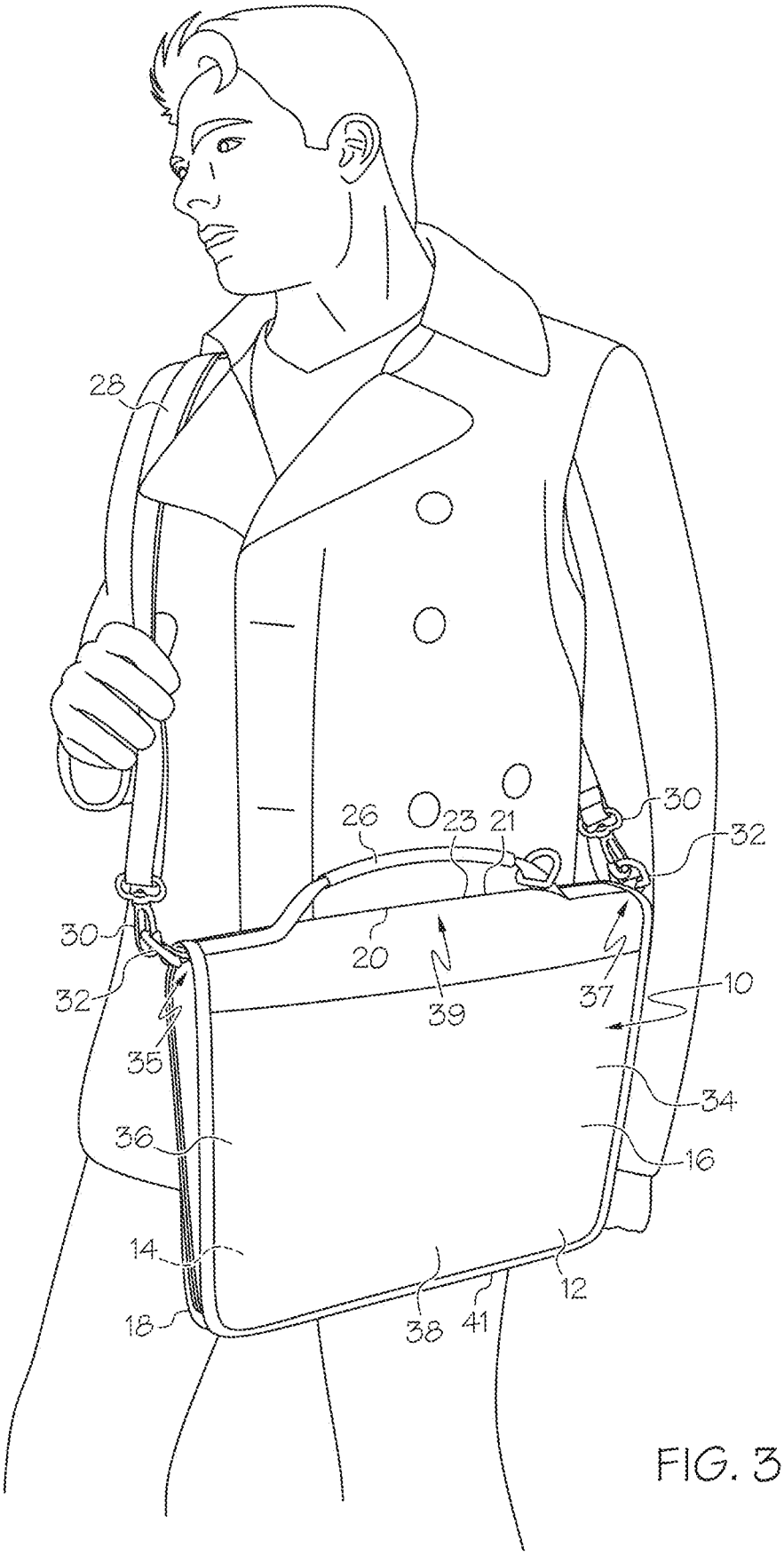
FIG. 3 is a front perspective view of the storage device of FIG. 1 being worn as a courier-type bag.
Figure 8:
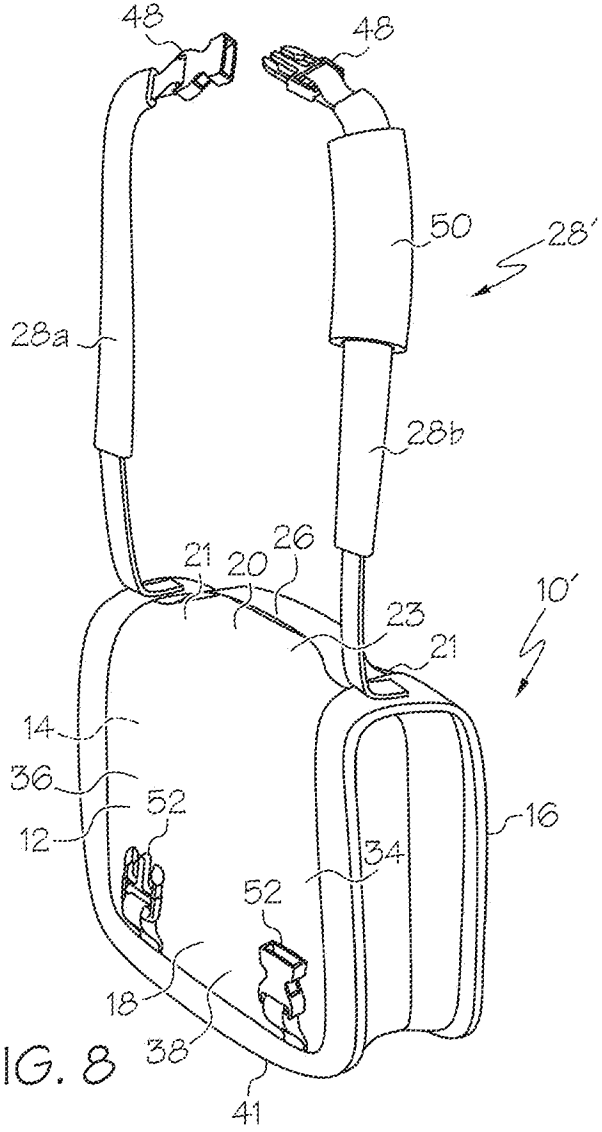
FIG. 8 is a rear perspective view of the storage device of FIG. 7 in its closed position with the strap disconnected.
Figure 7:
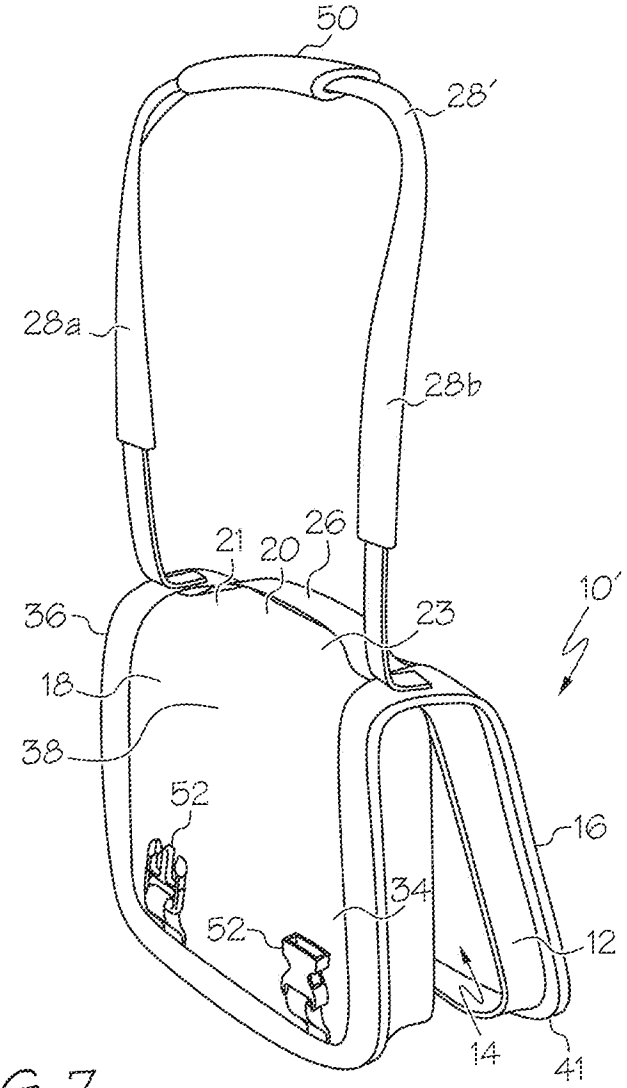
FIG. 7 is a rear perspective view of another embodiment of the storage device in its partially open position with the strap in its first configuration.
Figure 9:
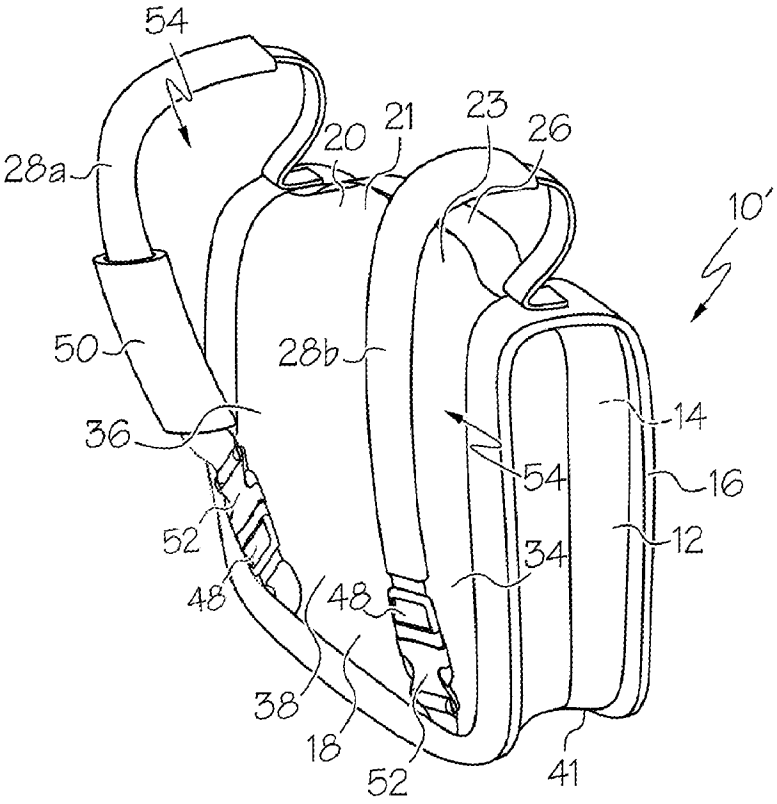
FIG. 9 is a rear perspective view of the bag of FIG. 8, with strap in its second configuration.

The storage device 10 also includes a carrying strap 28 that can be of a fixed or adjustable length and can be arranged in various configurations. The strap 28 can take the form of a longitudinally extending piece of material made of the same or different materials than the casing 12. In the embodiment of FIGS. 1-3, the distal ends of the strap 28 are releasably secured to the casing 12 by a set of clasps 30 which are secured to the strap 28. Each clasp 30 can then be removably passed through a corresponding loop 32 which is secured to the casing 12. However the distal ends of the strap 28 could instead be permanently attached to the casing 12, as shown in the embodiment of FIGS. 7-9, such as by stitching or the like, or releasably attached by structure other than the illustrated clasps 30/loops 32. Thus in at least one embodiment the distal ends of the strap 28 are fixedly, and not slidably or movably, coupled to the casing 12 in a manner described below. In one case the strap 28 is a single, continuous strap or piece of material, is and not separable into separate strap portions as contrasted with the strap 28' of, for example, FIG. 8. In one case the loops 32 are positioned along or adjacent to a top edge 23 of the casing 12.

The strap 28 is arranged in a first configuration in FIGS. 1-3 in which the strap 28 is secured to opposite, outer sides of the casing 12. When in the first configuration the strap 28/storage device 10 can be worn as a sling over a shoulder of a user and carried as courier-type bag, as shown in FIG. 3.

The storage device 10/casing 12 can be generally rectangular in front view, and in the first configuration the strap 28 is secured at or adjacent to first 34 and second 36 outer portions, respectively, which constitute left and right portions of the storage device 10/casing 12 in front view, between which is positioned a middle portion 38. Although the dimensions and delineations of the outer 34, 36 and middle 38 portions can vary, in one case each outer portion 34, 36 comprises an outer 25% of the length (extending laterally, in a generally left-to-right direction in FIG. 3) of the storage device 10/casing 12 in front view, and the middle portion 38 comprises the middle 50% of the length of the storage device 10/casing 12 in front view. In the illustrated embodiment the strap 28, when in the first configuration, is secured only at its ends and/or only to the first 34 and second 36 outer portions, and the strap 28 is not secured to the middle portion 38 thereof.

The storage device 10 can include a strap securing device 40 and a body securing device 42 which are releasably attachable together to thereby releasably attach the strap 28 to the casing 12, and more particularly in one case to the middle portion 38. The strap securing device 40 is positioned on or coupled to the strap 28, and in the illustrated embodiment takes the form of a hook or clasp 40 coupled to a loop 44 that is slidable along a length of the strap 28 (in one case slidable along at least about 50% of a length of the strap 28, or in another case a distance equal to at least about 50% of the length of the casing 12). The illustrated body securing device 42 is positioned on or coupled to the casing 12, and more particularly the handle 26 in the embodiment of FIGS. 1-5. The body securing device 42 can be slidable along a length of the handle 26 (in one case along at least about 50%, and in another along at least about 90%, of a length of the handle 26), and takes the form of a loop 42 in the illustrated embodiment. In one case the body securing device 42 is not slidable, and is instead fixed to the handle 26 and/or casing 12, With reference to FIG. 3, the casing 12 can have a length dimension (extending generally in a left-to-right direction), a height dimension (extending generally vertically) and a thickness dimension (extending generally into and out of the page of FIG. 3). The strap 28, when in the first configuration, can be configured to extend across substantially an entirety of the length dimension of the casing 12 (e.g. at least about 90% of the length dimension in one case). The strap 28 is coupleable to the outer portions 34, 36 at first 35 and second 37 attachment locations, respectively, and is coupleable to the middle portion 38 at a third attachment location 39. In one case the first 35, second 37 and third 39 attachment locations are all in the same half of the height of the casing 12, and more particularly in an upper portion or half of a height of the casing 12. In yet another embodiment, the first 35, second 37 and third 39 attachment locations are all located relatively close to each other in the height direction, e.g. within at least about 25% in one case, or at least about 10% in another case, of a height of the casing 12.

Figure 4:
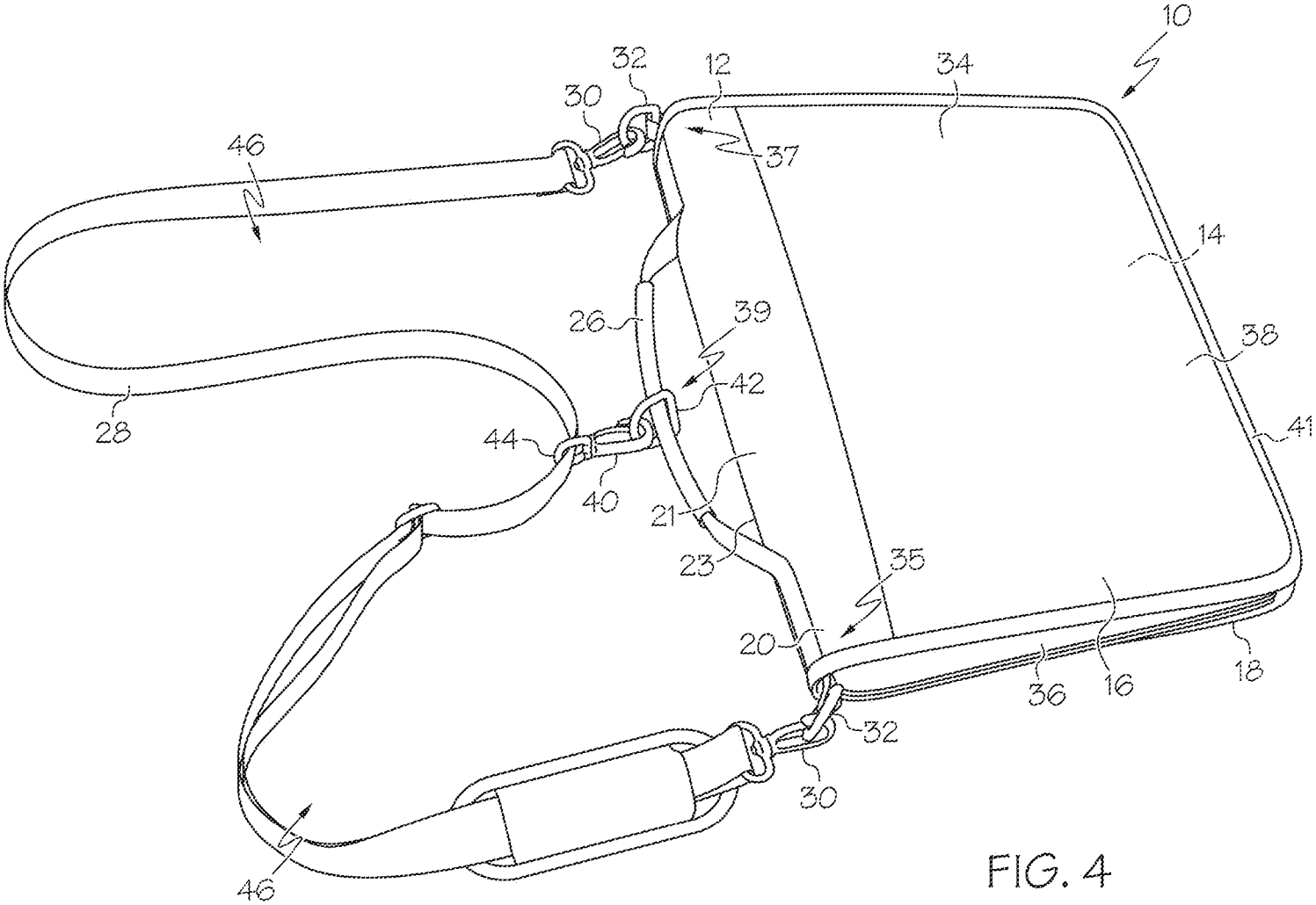
FIG. 4 is a front perspective view of the storage device of FIG. 1 with the strap in a second configuration.

The strap 28 can be moved to its second configuration by releasably securing the strap 28 to the casing 12, such as by connecting the strap securing device 40 to the body securing device 42, as shown in FIG. 4. In the illustrated embodiment the strap securing device 40 is secured to the body securing device by passing the securing device 40 through the loop 42. However, the position of the securing device 40 and loop 42 can of course be reversed, and moreover any of a wide variety of other structures and mechanisms can be used to secure the strap 28 and casing 12, such as zippers, hooks, buckles, brackets, hook-and-loop fastening material (such as VELCRO®), ties, inter-engaging shapes, magnets etc.

Figure 5:
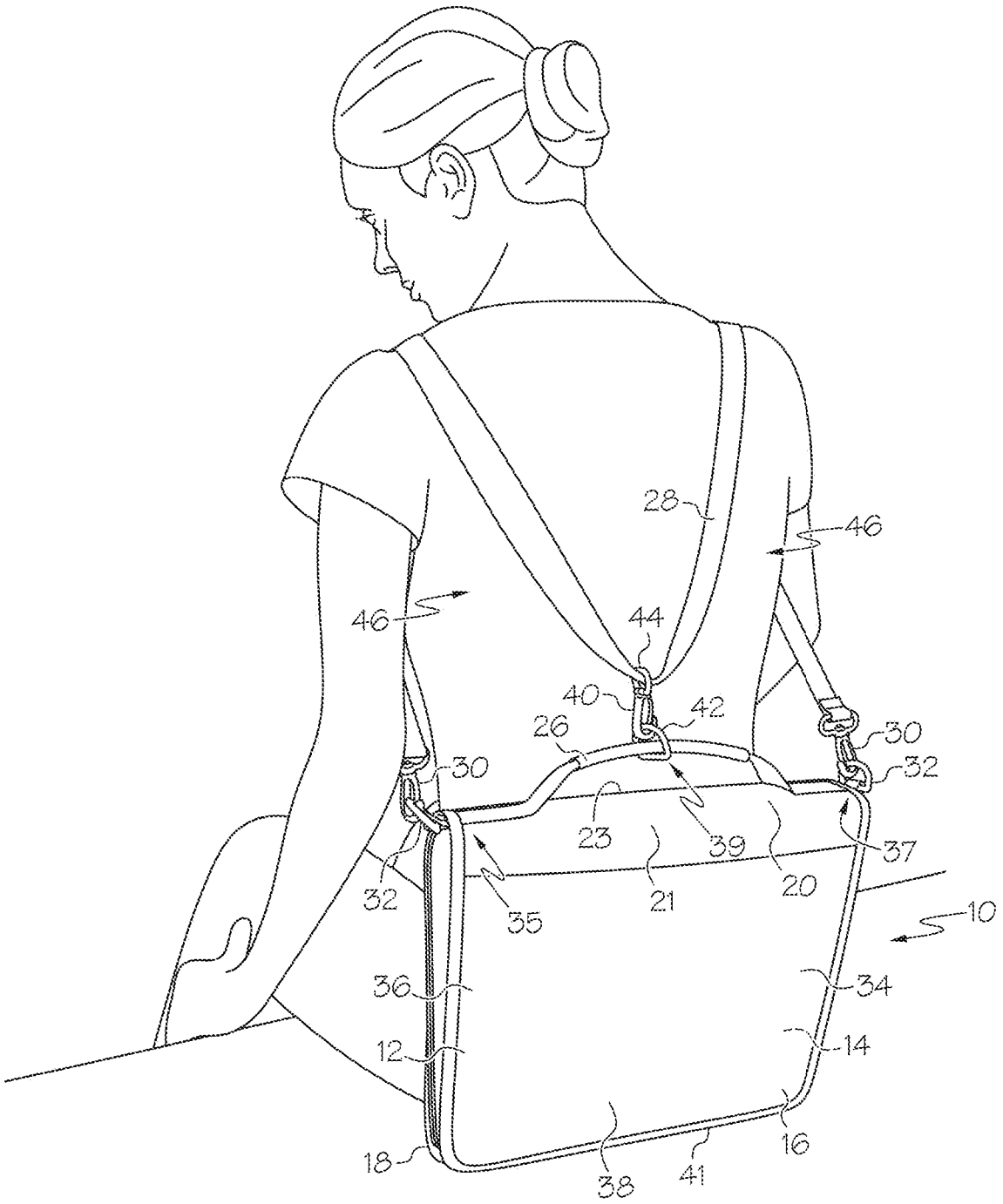
FIG. 5 is a front perspective view of the storage device of FIG. 4 being worn as a backpack-style bag.

When the strap 28 is secured to the casing 12 in its second configuration, the strap 28 is thereby secured to the middle portion 38 of the casing 12 and the strap 28 at least partially defines a pair of loops 46. Each loop 46 is shaped and configured to receive an arm of a wearer therethrough such that the storage device 10 can be carried on a back of the wearer in the manner of a backpack, as shown in FIG. 5 and in which case part of the loops 46 can be defined by the casing 12. When the strap 28 is in the first configuration the strap 28/casing 12 does not define the pair of loops 46. The strap 28 can be positioned entirely externally of the inner compartment 14 when in either the first configuration or the second configuration.

In the particular embodiment of FIGS. 1-5, both the strap securing device 40 and the body securing device 42 are slidable. This configuration can be useful to enable those components to automatically adjust to the position desired by the wearer, providing flexibility to adjust to various weight distributions, and to adjust laterally along the back of a wearer when, for example, a wearer leans against wall or is in a crowded location such as a bus or subway, etc. However, it is not required that the strap securing device 40 and the body securing device 42 both be slidable, and indeed one or both of those component can be configured in a fixed and non-slidable manner. For example, in the embodiment of FIG. 6 the body securing device 42 is generally fixedly and non-slidably secured to the casing 12.

Figure 6:
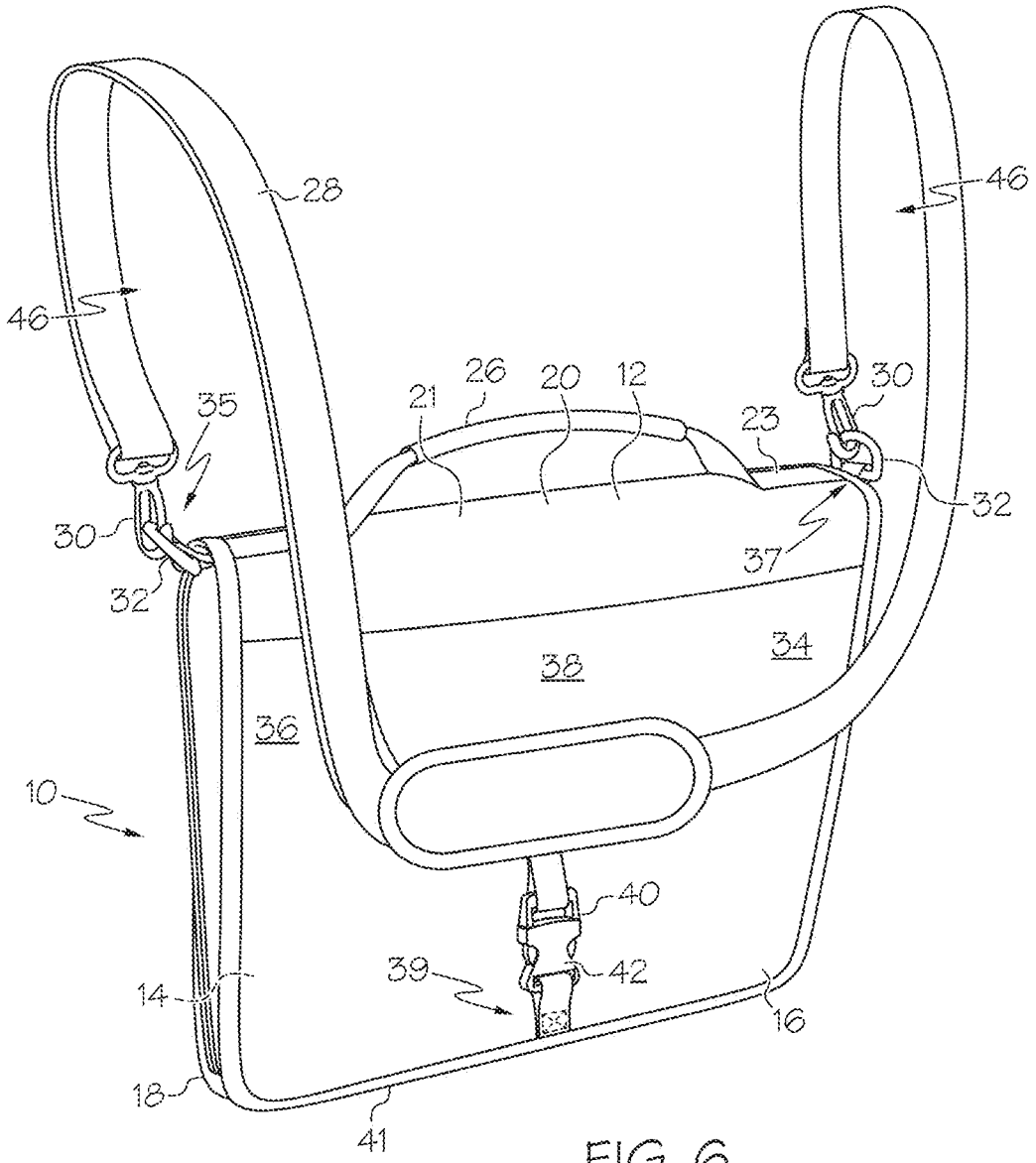
FIG. 6 is a front perspective view of another embodiment of the storage device with the strap in its second configuration.

It should also be understood that the body securing device 42 can be positioned at a variety of locations on the casing 12, and need not necessarily be positioned on the handle 26. For example, in the embodiment shown in FIG. 6 the body securing device 42 is positioned on a lower portion of the casing 12, spaced away from the handle 26. In one case, the body securing device 42 is positioned in a center of the casing 12, with respect to a length thereof (left-to-right direction), to provide balanced and centered shoulder straps or loops 46. As shown in FIG. 6, when strap 28 is secured to the middle portion 38 at the third attachment location 39, the third attachment location 39/body securing device 42 can be spaced away from an upper edge 23 of the casing 12, and in one case be positioned along or adjacent to a bottom edge 41 of the casing 12. This arrangement can help to ensure that when the casing 12 is worn as a backpack the casing 12 is positioned adjacent a back of the wearer, instead of hanging down low below the back of the wearer.

FIGS. 7-9 illustrate an alternative embodiment of the storage device 10' wherein the strap 28' includes a first strap segment 28*a* and a second strap segment 28*b* that are releasably attachable together. Each strap segment 28*a* is coupled to the casing 12 at a base end and has a free distal end that are attachable together. A strap segment attachment device 48, such as part of a clasp in the illustrated embodiment, is positioned at the distal end of each strap segment 28*a*, 28*b*. The strap segment attachment devices 48 are releasably attachable together to attach the strap segments 28*a*, 28*b* at their distal ends to form a continuous strap 28', as shown in FIG. 7. In this configuration the strap 28' can be worn as a sling over a shoulder of a user and worn as courier-type bag in the same manner as shown in FIG. 3. The strap 28' can also include a sleeve 50 that is slidably mounted on the strap 28', and can slide over and cover the strap segment attachment devices 48 when attached together, as shown in FIG. 7.

The strap 28' is also movable to a second configuration wherein each strap segment 28*a*, 28*b* is individually releasably attached to the casing 12, and more particularly to an outer portion 34, 36 of the casing 12 in one case. In particular, as shown in FIGS. 8 and 9 the strap segments 28*a*, 28*b* can be detached from each other and then releasably attached to the casing 12. The casing 12 may carry body securing devices 52, which are releasably securable with the associated strap segment attachment devices 48, as shown in FIG. 9.

In this configuration each strap segment 28*a*, 28*b* is releasably attached to the casing 12 at their distal ends to form a pair parallel of strap loops 54. Each strap loop 54 is shaped and configured to receive an arm of a user therethrough such that the storage device 10' can be carried on a back of the wearer in the manner of a backpack, analogous to the configuration shown in FIG. 5.

In the illustrated embodiment, one of the body securing devices 52 (the left body securing device 52, in the illustrated embodiment) has a male configuration, configured to be coupled to the corresponding strap segment attachment device 48 (the female strap segment attachment device 48, on the left in FIG. 8). Correspondingly, the other one of the body securing devices 52 (the right body securing device 52, in the illustrated embodiment) has a female configuration, configured to be coupled to the corresponding strap segment attachment device 48 (the male strap segment attachment device 48, on the right in FIG. 8). In this case each body securing device 52 is configured to be coupled only to a corresponding strap segment 28*a*, 28*b*, and is configured to not be coupleable to the non-corresponding strap segment 28*a*, 28*b*. This arrangement ensures that the strap segments 28*a*, 28*b* are secured by a user only in their proper backpack configuration, and are not inadvertently crossed and secured in place.

In this manner the storage device 10, 10' can be arranged in various different configurations to be carried in different manners. This provides great flexibility to allow the storage device 10 to be configured and carried as desired, and the reconfiguration process is intuitive and easy to implement.

Having described the invention in detail and by reference to the various embodiments, it should be understood that modifications and variations thereof are possible without departing from the scope of the invention.

What is claimed is:

1. A storage device comprising:

a body having a first cover and a second cover pivotally coupled together along a spine, the first cover and the second cover configured to at least partially define an inner compartment therebetween, wherein the body further includes a binding mechanism configured to bind paper or other items thereto positioned in the inner compartment;

a body securing device positioned on a lower portion of the body opposite the spine thereof, the body securing device attached to at least one of the first cover or the second cover at a middle portion thereof; and a strap including a first end and a second end, the first end coupled to the body at or adjacent the spine at a first strap attachment location, the second end coupled to the body at or adjacent the spine at a second strap attachment location, the strap further including a strap securing device positioned at a central portion thereof configured to be releasably coupled to the body securing device;

wherein the strap is attached to the body in a first configuration wherein the first end thereof is coupled to the first strap attachment location and the second end thereof is coupled to the second strap attachment location, and wherein the strap securing device is not coupled to the body securing device such that the strap is wearable over the shoulder of a user as a courier-type bag; and wherein the strap is attached to the body in a second configuration wherein the first end thereof is coupled to the first strap attachment location and the second end thereof is coupled to the second strap attachment location, and wherein the strap securing device is releasably coupled to the body securing device to define a pair of loops, each loop shaped to receive an arm of the user therethrough such that the storage device is wearable on a back of the user as a backpack.

2. The storage device of claim 1, wherein the first end of the strap is fixedly coupled to the body at the first strap attachment location, and wherein the second end of the strap is fixedly coupled to the body at the second strap attachment location.

3. The storage device of claim 1, wherein a distance between the first and second strap attachment locations extends across a majority of a length of the storage device in a direction parallel to the spine.

4. The storage device of claim 1, wherein the binding mechanism includes one or more binding rings.

5. The storage device of claim 1, wherein the body securing device is a female securing device and the strap securing device is a male securing device.

6. The storage device of claim 1, further comprising a handle portion positioned on the spine of the body, and wherein the first and second strap attachment locations are positioned on opposite sides of the handle portion.

7. The storage device of claim 1, wherein the body is shaped as a rectangular prism.

8. The storage device of claim 7, wherein the body further includes a releasable fastener extending along three sides thereof to releasably attach the first and second covers.

9. The storage device of claim 8, wherein the body includes a first gusset oriented perpendicular to the first cover and extending along the three sides of the body, and a second gusset oriented perpendicular to the second cover and extending along the three sides of the body, and wherein the releasable fastener releasably attaches the first and second covers.

10. The storage device of claim 1, wherein the second cover of the body is configured to be positioned adjacent the back of the user when the storage device is wearable as a backpack in the second configuration, and wherein the body securing device is coupled to the first cover of the body.

11. The storage device of claim 10, wherein the first cover includes a first side edge and a second side edge opposite the first side edge, and wherein the body securing device is fixedly coupled to the first cover at a center point equidistant from the first side edge and the second side edge.

12. The storage device of claim 1, wherein the first and second ends of the strap each include a clasp, and the first and second strap attachment locations each include a loop, and wherein the clasp of the first end is configured to be coupled to the loop of the first strap attachment location, and wherein the clasp of the second end is configured to be coupled to the loop of the second strap attachment location.

13. The storage device of claim 1, further comprising a sleeve slidably coupled to the strap, and wherein the strap securing device is directly coupled to the sleeve.

14. A storage device comprising:

a body having a first cover and a second cover pivotally coupled together along a spine, the first cover and the second cover configured to at least partially define an inner compartment therebetween;

a female body securing device positioned on a lower portion of the body opposite the spine thereof, the body securing device attached to at least one of the first cover or the second cover at a middle portion thereof; and a strap including a first end and a second end, the first end coupled to the body at or adjacent the spine at a first strap attachment location, the second end coupled to the body at or adjacent the spine at a second strap attachment location, the strap further including a male strap securing device positioned at a central portion thereof configured to be releasably coupled to the body securing device;

wherein the strap is attached to the body in a first configuration wherein the first end thereof is coupled to the first strap attachment location and the second end thereof is coupled to the second strap attachment location, and wherein the strap securing device is not coupled to the body securing device such that the strap is wearable over the shoulder of a user as a courier-type bag; and wherein the strap is attached to the body in a second configuration wherein the first end thereof is coupled to the first strap attachment location and the second end thereof is coupled to the second strap attachment location, and wherein the strap securing device is releasably coupled to the body securing device to define a pair of loops, each loop shaped to receive an arm of the user therethrough such that the storage device is wearable on a back of the user as a backpack.

15. The storage device of claim 14, wherein the body further includes a binding mechanism configured to bind paper or other items thereto positioned in the inner compartment.

16. The storage device of claim 15, wherein the binding mechanism includes one or more binding rings.

17. The storage device of claim 14, wherein the second cover of the body is configured to be positioned adjacent the back of the user when the storage device is wearable as a backpack in the second configuration, and wherein the body securing device is coupled to the first cover of the body.

18. The storage device of claim 17, wherein the first cover includes a first side edge and a second side edge opposite the first side edge, and wherein the body securing device is fixedly coupled to the first cover at a center point equidistant from the first side edge and the second side edge.

19. The storage device of claim 14, further comprising a handle portion positioned on the spine of the body, and wherein the first and second strap attachment locations are positioned on opposite sides of the handle portion.

20. A method comprising:

providing a storage device, the storage device including:

a body having a first cover and a second cover pivotally coupled together along a spine, the first cover and the second cover configured to at least partially define an inner compartment therebetween, wherein the body further includes a binding mechanism configured to bind paper or other items thereto positioned in the inner compartment;

a body securing device positioned on a lower portion of the body opposite the spine thereof, the body securing device attached to at least one of the first cover or the second cover at a middle portion thereof; and a strap including a first end and a second end, the first end coupled to the body at or adjacent the spine at a first strap attachment location, the second end coupled to the body at or adjacent the spine at a second strap attachment location, the strap further including a strap securing device positioned at a central portion thereof configured to be releasably coupled to the body securing device;

wherein the strap is configured to be attached to the body in a first configuration wherein the first end thereof is coupled to the first strap attachment location and the second end thereof is coupled to the second strap attachment location, and wherein the strap securing device is not coupled to the body securing device such that the strap is wearable over the shoulder of a user as a courier-type bag; and wherein the strap is configured to be attached to the body in a second configuration wherein the first end thereof is coupled to the first strap attachment location and the second end thereof is coupled to the second strap attachment location, and wherein the strap securing device is releasably coupled to the body securing device to define a pair of loops, each loop shaped to receive an arm of the user therethrough such that the storage device is wearable on a back of the user as a backpack; and moving the strap between the first configuration and the second configuration.

* * * * *